US006195958B1

(12) United States Patent
Neifer et al.

(10) Patent No.: US 6,195,958 B1
(45) Date of Patent: Mar. 6, 2001

(54) APPARATUS FOR PROPELLING A CARRIAGE ALONG THE LENGTH OF PURLINS OF A ROOF STRUCTURE

(75) Inventors: Don Albert Neifer, Granville, OH (US); Ernest Craig Abney, Deltona, FL (US); James Allen Martin, Heath, OH (US)

(73) Assignee: Owens Corning Fiberglass Technology, Inc., Summit, IL (US)

( * ) Notice: Subject to any disclaimer, the term of this patent is extended or adjusted under 35 U.S.C. 154(b) by 0 days.

(21) Appl. No.: 09/052,735

(22) Filed: Mar. 31, 1998

(51) Int. Cl.[7] ..... E04D 15/06

(52) U.S. Cl. ..... 52/749.12; 52/746.11; 52/404.1; 52/407.4; 242/557; 242/598.5; 270/30.11; 270/30.13

(58) Field of Search ..... 52/404.1, 407.1, 52/407.4, 407.5, 408–410, 478, 483.1, 749.12, 746.11; 242/546, 548, 557, 592, 598.5, 610; 270/30.11, 30.13

(56) References Cited

U.S. PATENT DOCUMENTS 3,983,676 10/1976 Gilpin .
4,068,446 1/1978 Brueske .
4,967,535 11/1990 Alderman .
5,653,083 * 8/1997 Alderman et al. ..... 52/749.12
5,685,123 * 11/1997 Alderman et al. ..... 52/749.12
5,911,385 * 6/1999 Neifer et al. ..... 242/557
5,921,057 * 7/1999 Alderman et al. ..... 52/746.11
5,946,804 * 9/1999 Alderman ..... 29/897.1
6,041,568 * 3/2000 Alderman et al. ..... 52/749.12

* cited by examiner

*Primary Examiner*—Carl D. Friedman
*Assistant Examiner*—Yvonne M. Horton
(74) *Attorney, Agent, or Firm*—Inger H. Eckert; Stephen W. Barns

(57) ABSTRACT

An apparatus for propelling a carriage along a roof structure of the type having a plurality of purlins spaced apart from one another in a parallel arrangement, and method of using same are disclosed. The apparatus includes a carriage movable along the length of the purlins for dispensing a support sheet from a roll for support of insulation material as the carriage travels along the length of the purlins so that the support sheet depends from the top portion of adjacent purlins. The apparatus further includes a puller assembly attached to the carriage. The puller assembly includes a driven wheel frictionally engaged with a surface a purlin, and a drive mechanism for rotating the driven wheel.

20 Claims, 9 Drawing Sheets

APPARATUS FOR PROPELLING A CARRIAGE ALONG THE LENGTH OF PURLINS OF A ROOF STRUCTURE

TECHNICAL FIELD AND INDUSTRIAL APPLICABILITY OF THE INVENTION

This invention relates to the construction of an insulated metal roof structure for use in commercial and industrial buildings.

BACKGROUND OF THE INVENTION

Metal roof structures typically comprise a series of parallel rafter beams extending across the building in one direction and purlin beams parallel to each other mounted on top of the rafters extending in a direction normal to the rafters. Insulation is material in long sheets is placed in the area between purlins. The sheets of insulation material can be laid along the length of the purlins or across the purlins in a direction normal to the purlins. If desired, the roof structure can have a first layer of insulation material which is laid along the length of the purlins, and a second layer of insulation material which is laid laterally across the purlins on top of the first layer on insulation. Hard roofing material such as metal decking is then attached on top of the purlins over the insulation material. Because the hard roofing material comes in long sheets and the roofs generally have two sloped sections, it is customary to construct the roof along the length of the structure from one end to the other. The workers stand on the previously laid section of roof to construct the next section.

The insulation material is supported between the purlins beneath the hard roofing material. Various methods of supporting the insulation material have been used. Mounting straps or wire mesh which are attached to or draped over the purlins forming a lattice have been used. This is referred to as banding. A sheet, typically made of vinyl and acting as a vapor barrier, is then rolled onto the lattice, and insulation material is placed between adjacent purlins and over the sheet. If the installation of the lattice is done from underneath the roof structure, scaffolding or lifting equipment is typically required for installation. Since the lattice encompasses the entire roof, installation is costly and time consuming. Once the hard roofing material is mounted on the purlins, the sheet can support the insulation material and the lattice no longer serves any useful purpose.

Some systems dispense with the lattice and use the sheet itself to support the insulation material. The support sheet is dispensed from a roll and draped from adjacent purlins. Insulation material is then placed on top of the support sheet. A carriage has been used to aid in the dispensing of the support sheet, such as that disclosed in U.S. Pat. No. 4,967,535 to Alderman. The carriage is positioned on top of the purlins and travels the length of the purlins during the roof construction. A roll of the support sheet material is mounted on the carriage and the support sheet is dispensed from the roll and placed on top of the purlins. As the carriage travels the length of the purlins, the support sheet is draped across the purlins.

The carriage can be any length up to the width of the roof itself. For example, the carriage can be comprised of a plurality of carriage sections which are joined together so that they span the entire width of the roof. Each carriage section has a roll of support sheet dispensing the support sheet across two adjacent purlins. The carriage is then propelled along the length of the purlins so that the carriage sections move in unison.

In the past, the carriage was manually pushed across the roof along the length of the purlins by means of push rods. The workers standing on a completed section of the roof structure would manually push the carriage to the desired position. Another method of advancing the carriage was by pulling the carriage across the roof by means of a relatively long cable and large winch fastened to the carriage. The cable was typically 200 feet long and had a conventional hook attached at the end of the cable. The cable was reeled out from the spool of the winch and then hooked to a flange of a rafter beam. If the roof structure was longer than 200 feet, the cable was attached to the farthest rafter beam which the cable was able to reach. The winch was then manually operated to take up the cable about the spool of the winch so as to advance the carriage. It was preferred that the cable be as long as possible, so that the cable did not have to be re-attached to a different rafter beam often. Because the winch is attached to the carriage and moves over and across the rafter beams, the cable is laid across the tops of all the rafter beams between the carriage and the end of the roof structure. However, it can be difficult and time consuming to unroll the cable and pull the end of the cable across the rafter beams 200 feet away from the carriage. It is also difficult to initially attach the hook at the end of the roof structure since this requires a worker to climb to the top of the end of the roof structure. Since the cable is relatively long, the cable is relatively heavy and awkward to handle. Also, the size of the winch is relatively large and heavy to accommodate the length of the cable required to span across the roof structure.

It would be desirable to have an apparatus and method for moving the carriage along the length of the purlins which is relatively simple, fast, and safe to perform.

SUMMARY OF THE INVENTION

The above objects as well as other objects not specifically enumerated are achieved by an apparatus and a method of using the same for propelling a carriage along a roof structure. The apparatus and method provides for a relatively simple and fast system for moving the carriage.

The apparatus of the present invention provides for a roof structure of the type having a plurality of purlins spaced apart from one another in a parallel arrangement. The apparatus includes a carriage movable along the length of the purlins for dispensing a support sheet from a roll for support of insulation material as the carriage travels along the length of the purlins so that the support sheet depends from the top portion of adjacent purlins. The apparatus further includes a puller assembly attached to the carriage. The puller assembly includes a driven wheel frictionally engaged with a surface of a purlin, and a drive mechanism for rotating the driven wheel.

The method of the present invention includes first providing a carriage upon which is mounted a roll of support sheet, wherein the support sheet has side edges which are generally aligned with the top portions of adjacent purlins so that the support sheet can depend from the adjacent purlins. A puller assembly is also provided for rotating a driven wheel. The puller assembly is attached to the carriage. The driven wheel is then positioned adjacent a purlin for frictional engagement therewith. Next, the puller assembly is actuated to rotate the driven wheel so that the driven wheel rolls along the length of the purlin, thereby propelling the carriage along the purlins.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

Figure 2:
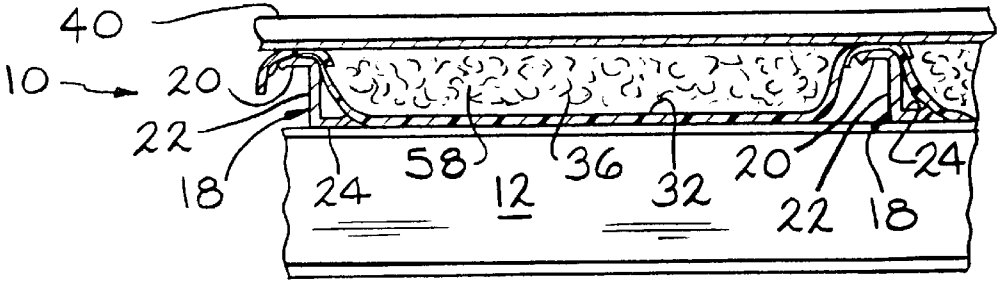
FIG. 2 is a schematic sectional view taken along Lines 2—2 of FIG. 1 illustrating a completed section of the insulated roof structure.
Figure 1:
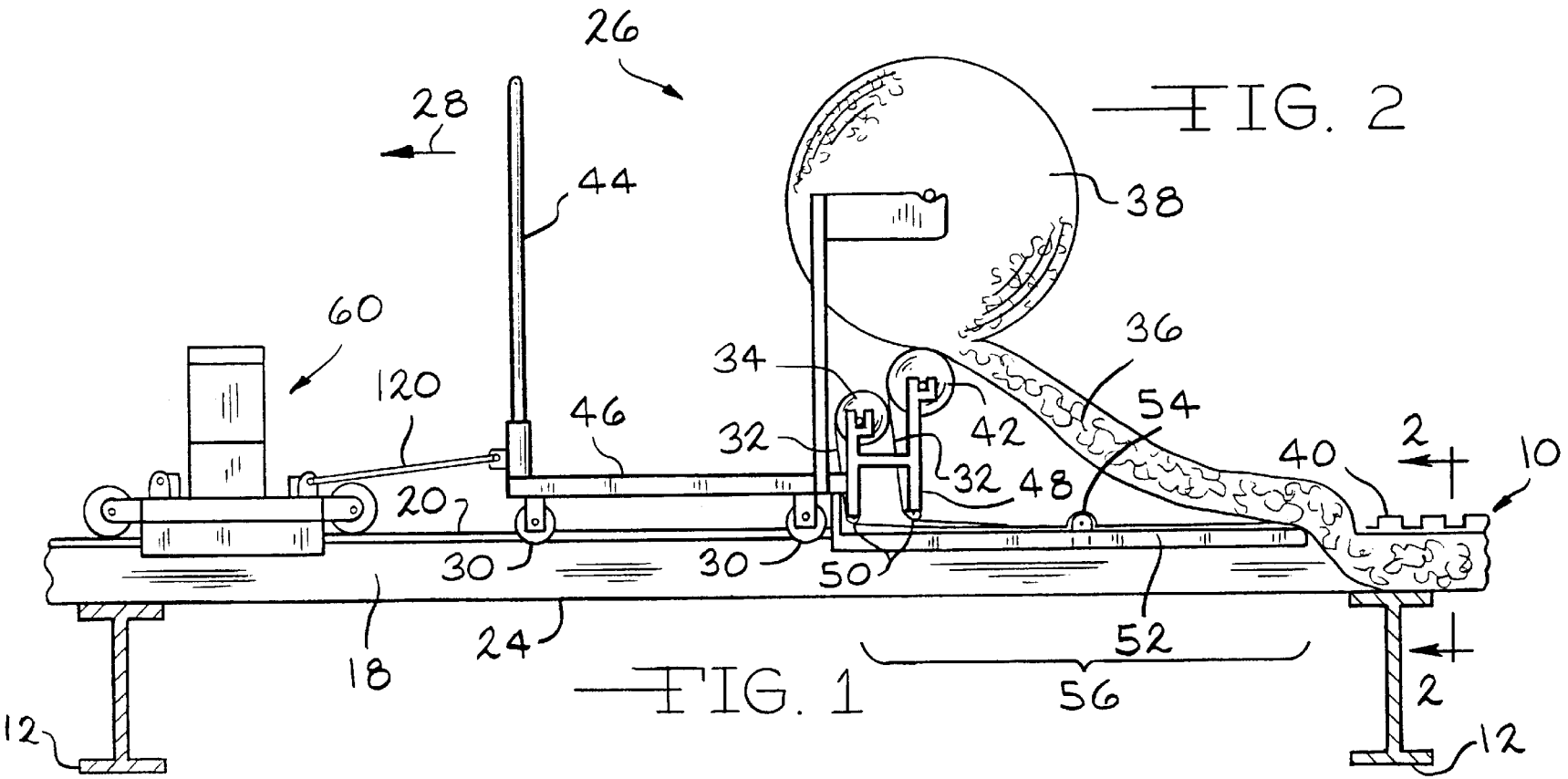
FIG. 1 is a schematic elevational side view of a carriage and a first embodiment of a puller assembly, in accordance with the present invention, on top of a roof structure.

Referring to FIGS. 1 and 2, there is illustrated a partially completed building roof structure, indicated generally at 10. The roof structure is supported by a building framework which includes main rafter beams 12 positioned parallel to each other. A plurality of purlins 18, spaced apart and arranged parallel to each other, is fastened on top of the rafters in a direction normal to the rafters. The building framework may have two sloped sections (not shown) which are joined together to form a peak. The sloped roof sides generally provide for rain and snow drainage. The spacing of the rafter beams is typically within the range of from about 25 to about 30 feet (7.6 to about 9.1 meters) on centers. The spacing of the purlins is typically about 5 feet (1.52 m) on centers. As best shown in FIG. 2, the purlins typically have a generally Z-shaped cross-section, and include a horizontally extending upper portion 20, a vertically extending web 22, and a horizontally extending lower portion 24. Of course, roof structures may also be constructed from bar joists or trusses, and the invention as described herein will work equally well with purlins, bar joists or trusses. The use of the term "purlins" in this specification and claims includes not only traditional purlins, but also joists, trusses, and other similar structural members.

Broadly stated, the roof structure is constructed by use of a carriage, indicated generally at 26, which rides on the upper portion 20 of the purlins and travels along the length of the purlins in a downstream direction, represented by an arrow 28, as shown in FIG. 1. Preferably, the carriage has rollers 30, rotatably mounted on the carriage, which roll along the upper portions of the purlins. As the carriage is moved, a support sheet 32 is payed out from a roll 34. The support sheet is draped on top of adjacent purlins so that the support sheet depends from the upper portion of the purlins, as shown in FIG. 2. The support sheet supports a layer of insulation material 36 which is placed on top of the support sheet between the adjacent purlins. The insulation material is typically dispensed from a roll 38 but can be applied by any suitable manner, such as by applying insulation batts on top of the support sheet. Alternatively, a layer of insulation may be placed laterally across the purlins. After the insulation material has been placed on the support sheet, long sheets of hard roofing material 40, such as metal roof decking, are then attached to the upper portion of the purlins over the support sheet and insulation. The hard roofing material can be fastened to the purlins in any suitable manner, such as by threaded fasteners or clips. The attachment of the hard roofing material presses down on the edges of the support sheet which are sandwiched between the upper portion 20 of the purlins and the hard roofing material 40, so that the support sheet supports the insulation between the purlins.

Because the hard roofing material comes in long sheets, typically 30 to 35 feet (9.1 to 10.7 m), and the roofs generally have two sloped roof sides, it is customary to construct a first section of the roof structure along the width of the sloped roof side and then proceed along the length of the structure from one end to the other. The workers stand on the previously attached first section of the roof structure to assemble the next section of roof. The carriage travels along the length of the purlins and is moved by the workers as each new section of roof is assembled.

The carriage can be any length up to the width of the roof itself. Preferably, the carriage is comprised of a plurality of carriage sections which can be joined together so that they span the entire width of the sloped section of the roof. The carriage is then propelled across the purlins, as will be discussed in detail below, in the downstream direction 28 so that all the carriage sections move in unison. Because the support sheet is draped across the upper portion of adjacent purlins, the total width of the support sheet is wider than the distance between the purlins. Therefore, adjacent support sheet rolls are not co-linear and must be slightly staggered. Typically, a carriage section covers two purlin spans, i.e., about 10 feet (3.3 m) in length. Therefore, each carriage section preferably has both a leading roll 34 and a trailing roll 42 of insulation support sheet, one roll for each of two adjacent purlin spans. The edge of the support sheet from the trailing roll 42 will be draped on top of the edge of the support sheet from the leading roll 34 as the carriage moves in the downstream direction. Multiple identical carriage sections having a leading and trailing roll can, therefore, be joined together, with every roll being staggered from an adjacent roll.

The carriage 26 can be any suitable apparatus which moves along the top of the purlins and dispenses the support sheet. As seen from FIG. 1, the carriage preferably includes safety handrails 44 and a deck 46 for the worker to stand on while operating or moving the carriage. The rollers 30 are mounted from the deck 46 of the carriage. Preferably, the carriage is equipped with two rollers (front and rear) for each purlin, as shown in FIG. 1. The carriage also includes a framework 48 for mounting the rolls 34 and 42. Mounted on the framework are turning bars 50 which extend laterally across associated support sheets and are positioned slightly above the upper portions 20 of the purlins 18 so as to direct the support sheet to a generally horizontal position.

Attached to the carriage is an optional plate 52 which extends from the carriage in an upstream direction opposite the downstream direction 28. The plate supports the payed out portion of the support sheet and insulation material so that the support sheet does not drape downwardly, thereby pulling the longitudinal edges of the support sheet off the upper portion of the purlins. If sufficiently built, the plate can be used for fall protection for the workers to prevent them from falling off the leading edge of the previously completed section of roof. The plate can be attached to the carriage by any suitable means. The plate follows the carriage as the carriage moves along the length of the purlins. Preferably, the plate has wheels 54 which also support the plate by rolling along the upper portion 20 of the purlins 18. However, it is not required that the payed out support sheet be supported by the plate. The carriage could be modified so that the support sheet is payed out in such a manner that the support sheet is underneath the plate. If desired, the roll 38 of insulation material 36 could be positioned on the plate 52 above the support sheet. Generally, the plate is located in a gap 56 which exists between the completed section of the roof structure 10 and the carriage 26. The plate hinders wind from blowing vertically through the gap 56 and therefore, the wind does not disturb the insulation material 36 and the support sheet 32.

The space between the vertical webs 22 of adjacent purlins 18 generally defines an insulation cavity 58, as shown in FIG. 2. The insulation cavity has a generally rectangular cross-sectional shape. It is advantageous to fill out the insulation cavity uniformly with the insulation material without leaving relatively large gaps, thereby maximizing the insulating qualities of the roof structure. The purpose of the support sheet is to support the insulation material in the insulation cavity, but the support sheet can also be used as a vapor barrier, and for aesthetic purposes. The support sheet can be of any suitable material for the stated purposes, such as vinyl or foil faced paper.

The carriage 26 is propelled or advanced along the length of the purlins in the downstream direction 28 by a puller assembly, indicated generally at 60, in accordance with the present invention. The puller assembly 60 can be any suitable apparatus which is attached to the carriage and includes a drive mechanism for rotating at least one driven wheel (not shown in FIG. 2) which frictionally engages a surface of a purlin. The rotation of the driven wheel causes the puller assembly and the attached carriage to move along the length of the purlins. Any suitable driving configuration between the driven wheel and the purlin can be used. A plurality of puller assemblies may be used to advance a relatively wide carriage, such as when a plurality of carriage sections are joined together.

Figure 3:
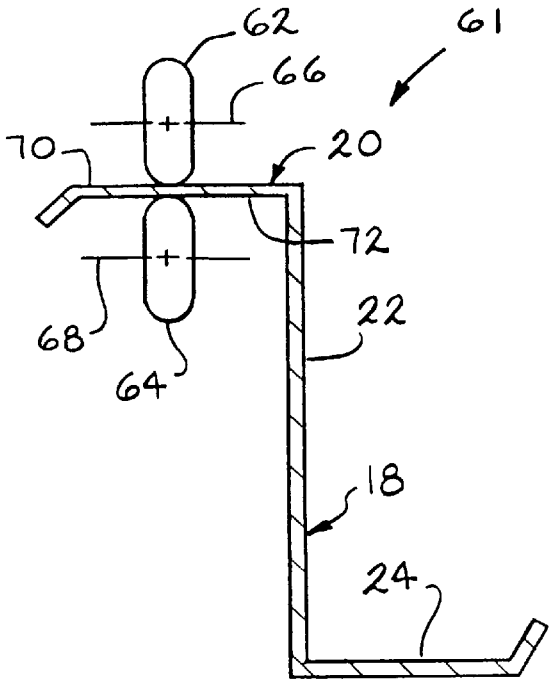
FIG. 3 is a schematic elevational view illustrating a first embodiment of a driving configuration between a pair of wheels engaged with a purlin.

For example, there is illustrated in FIG. 3 a first embodiment of a driving configuration, indicated generally at 61, between a pair of wheels 62 and 64 engaging a purlin 18. The wheel 62 rotates about an axis 66. The wheel 64 rotates about an axis 68. The wheels 62 and 64 are positioned on opposing sides of the upper portion 20 of the purlin so that the purlin is sandwiched or pinched between the wheels 62 and 64. The wheels 62 and 64 are in frictional engagement with surfaces 70 and 72, respectively, of the upper portion of the pirlin such that there is substantially no slippage between the surface of the wheels 62 and 64 and the respective surfaces of the purlin. Preferably, the wheels 62 and 64 are biased in a direction towards one another to assist in maintaining a frictional engagement between the surfaces of the wheels and the respective surfaces of the purlin. The driving configuration 61 can be arranged so that the wheel 62 is the driven wheel, the wheel 64 is the driven wheel, or both of the wheels 62 and 64 are driven wheels. Alternatively, the wheel 64 can be eliminated, wherein the weight of the structure above the wheel 62 assists in maintaining a frictional engagement between the surface of the wheel 62 and the surface 70 of the upper portion of the purlin.

Figure 4:
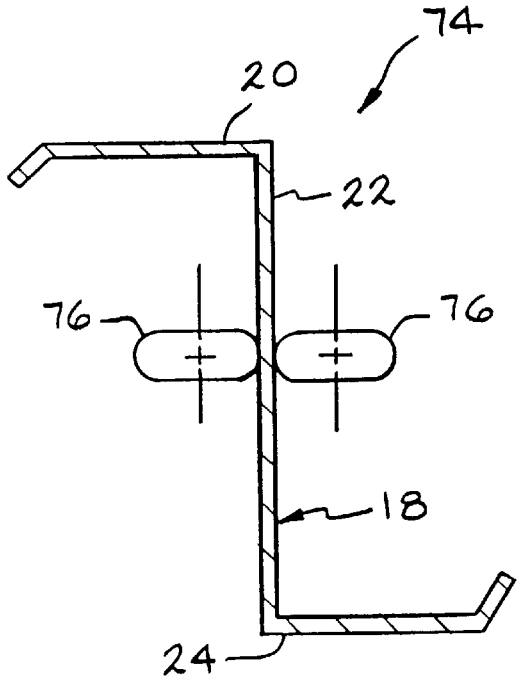
FIG. 4 is a schematic elevational view illustrating a second embodiment of a driving configuration between a pair of wheels and a purlin.
Figure 5:
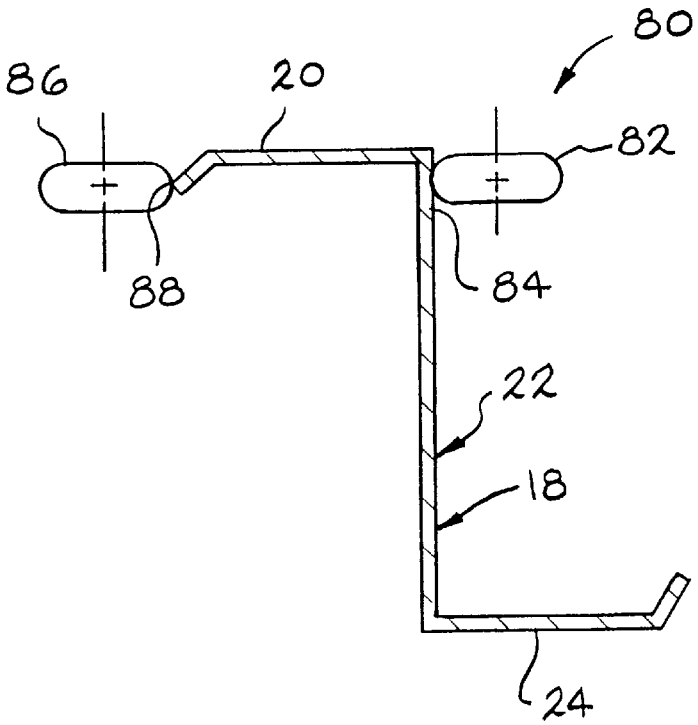
FIG. 5 is a schematic elevational view illustrating a third embodiment of a driving configuration between a pair of wheels and a purlin.
Figure 6:
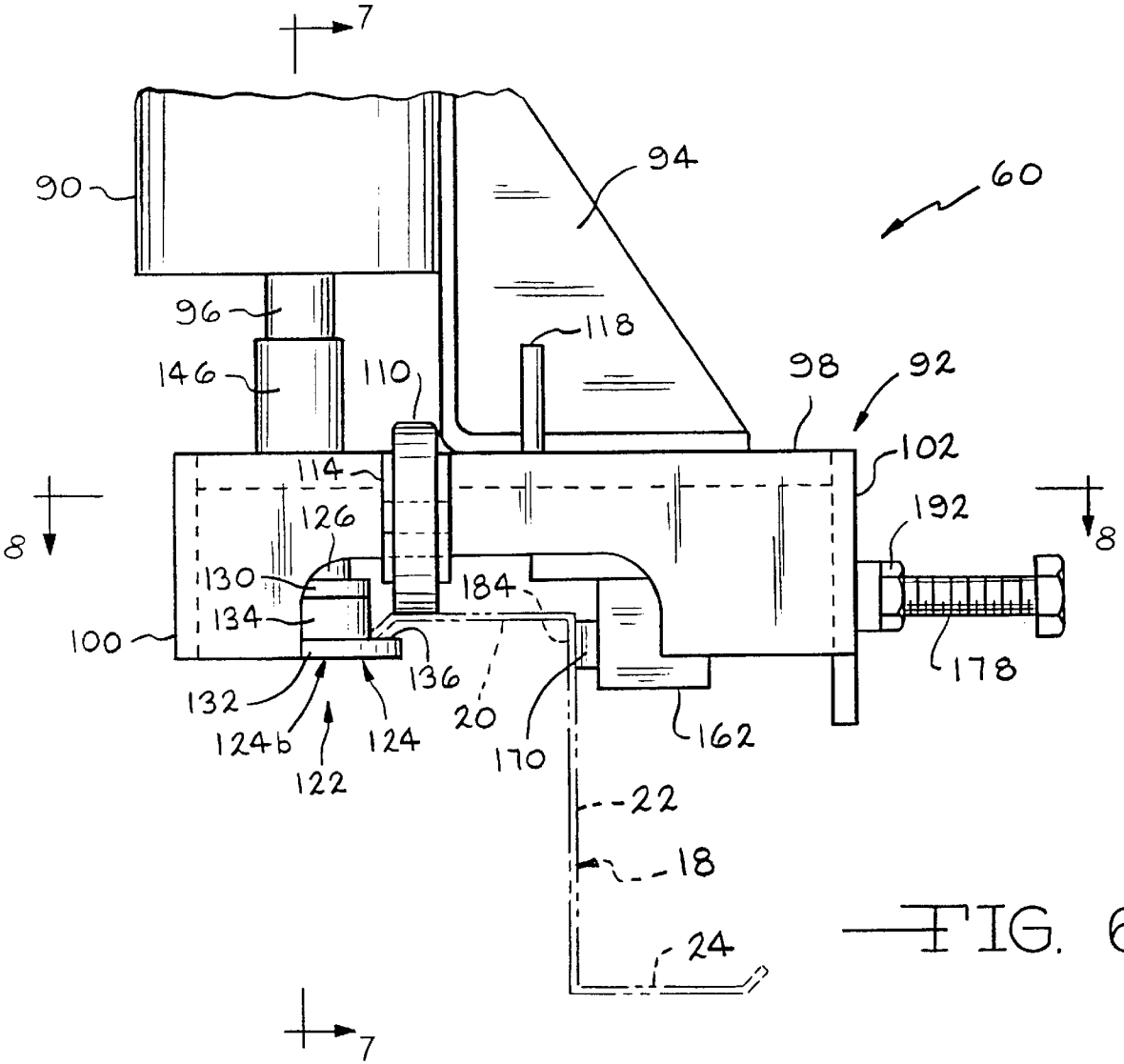
FIG. 6 is an elevational side view of the puller assembly of FIG. 1

In another example, there is shove in FIG. 4 a second embodiment of a driving configuration, indicated generally at 74, which is similar to the driving configuration 61 of FIG. 3, with the exception that the driving configuration 74 has a pair of wheels 76 frictionally engaging the vertical web 22 of the purlin 18. In yet another example, there is shown in FIG. 5 a third embodiment of a driving configuration, indicated generally at 80, which is similar to the driving configuration 61 of FIG. 3. The driving configuration 80 has a wheel 82 which is frictionally engaged with a top portion 84 of the vertical web 22, and a wheel 86 which is frictionally engaged with an edge 88 of the upper portion 20 of the purlin.

Referring to FIGS. 6 through 10, the puller assembly 60 generally includes a drive mechanism, such as a motor 90, and a main body, indicated generally at 92. The motor is attached to the main body by a mounting bracket 94. Actuation of the motor rotates an output shaft 96. The motor can be energized by any suitable power device, such as a generator or battery (not shown). Of course, the drive mechanism can be any suitable apparatus, such as a crank, for rotating the output shaft 96.

The main body includes an upper plate 98, a pair of side plates 100 and 102, and a pair of end plates 104 and 106. A pair of rollers 108 and 110 are rotatably mounted on the end plates 104 and 106, respectively, by mounting brackets 112 and 114. The rollers 108 and 110 roll along the upper portion 20 of the purlin 18 as the puller assembly 60 moves along the length of the purlin. A pair of cable attachments 116 and 118 are fastened to the upper plate 98. One end of a cable 120 is fastened to the cable attachment 118 while the other end of the cable 120 is attached to the carriage 26, as shown in FIG. 1, thereby attaching the carriage to the puller assembly. Note that the cable attachment 116 is used when the puller assembly is oriented 180 degrees about the purlin.

Figure 7:
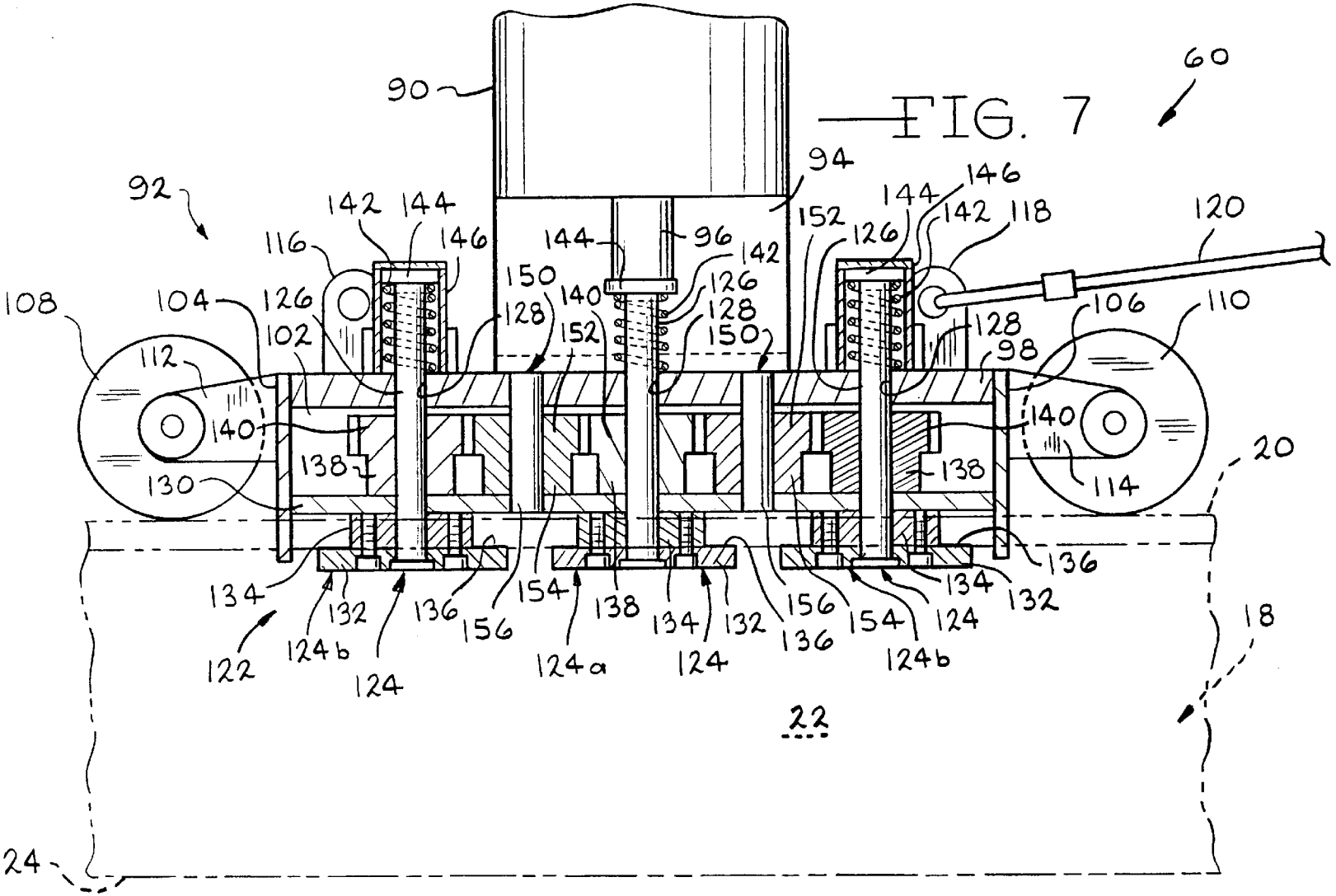
FIG. 7 is a partial sectional view of the puller assembly taken along Lines 7—7 of FIG. 6.

As best seen in FIG. 7, the puller assembly further includes a driven wheel assembly, indicated generally at 122. The driven wheel assembly includes three driven wheels 124 oriented in a manner similar to the wheel 86 in FIG. 5. Each driven wheel includes a shaft 126 extending through holes 128 formed through a ledge 130. The ledge 130 is attached to the side plate 100 and the end plates 104 and 106. Attached to each shaft is a large diameter portion 132 and a small diameter portion 134 positioned underneath the ledge 130. The large diameter portion 132 and the small diameter portion 134 are positioned adjacent each other, defining a shoulder 136. Each driven wheel further includes a spacer 138 and a gear 140 positioned above the ledge 130. The spacer and the gear are attached to the respective shafts 126 for rotation therewith. Each driven wheel is biased in an upward direction, as viewing FIG. 7, by a spring 142 acting against a washer 144. The washers 144 are attached to their respective shafts. Preferably, the shaft 126 of a centrally located driven wheel 124*a* is rotatably connected to the output shaft 96 of the motor 90 such that rotation of the output shaft rotates the shaft 126 while permitting a limited amount of axial movement therebetween. The springs of outwardly located driven wheels 124*b* are disposed in tubular spring retainers 146.

The driven wheel assembly further includes a pair of idler gear assemblies 150 each having a gear 152 and a spacer 154. The gears 152 are rotatably mounted about pins 156 attached to the upper plate 98 and the ledge 130. The gears 152 are positioned between the gears 140 of the driven wheels 124 and are in meshed engagement therewith.

Figure 8:
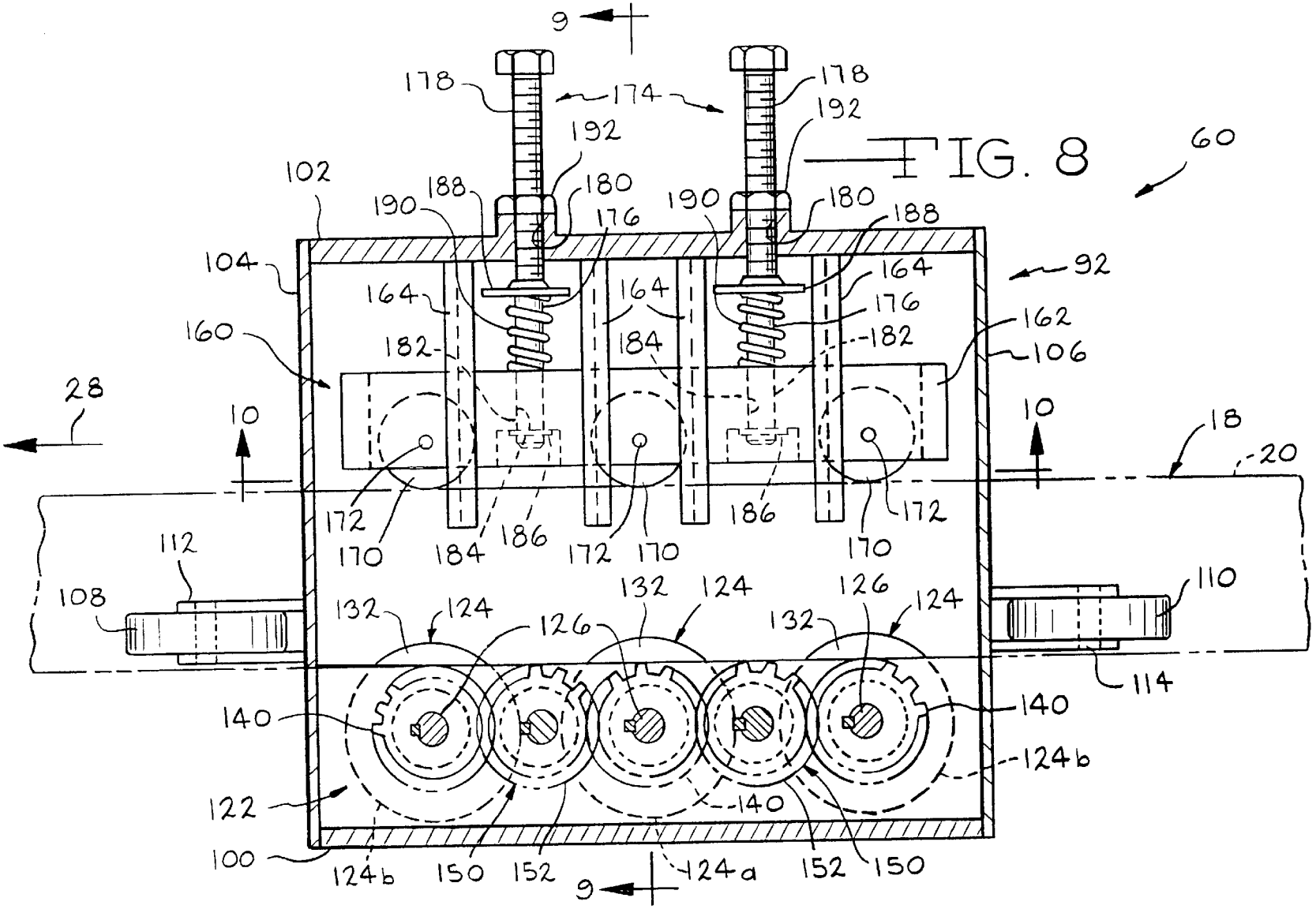
FIG. 8 is a partial sectional view of the puller assembly taken along Lines 8—8 of FIG. 6.
Figure 9:
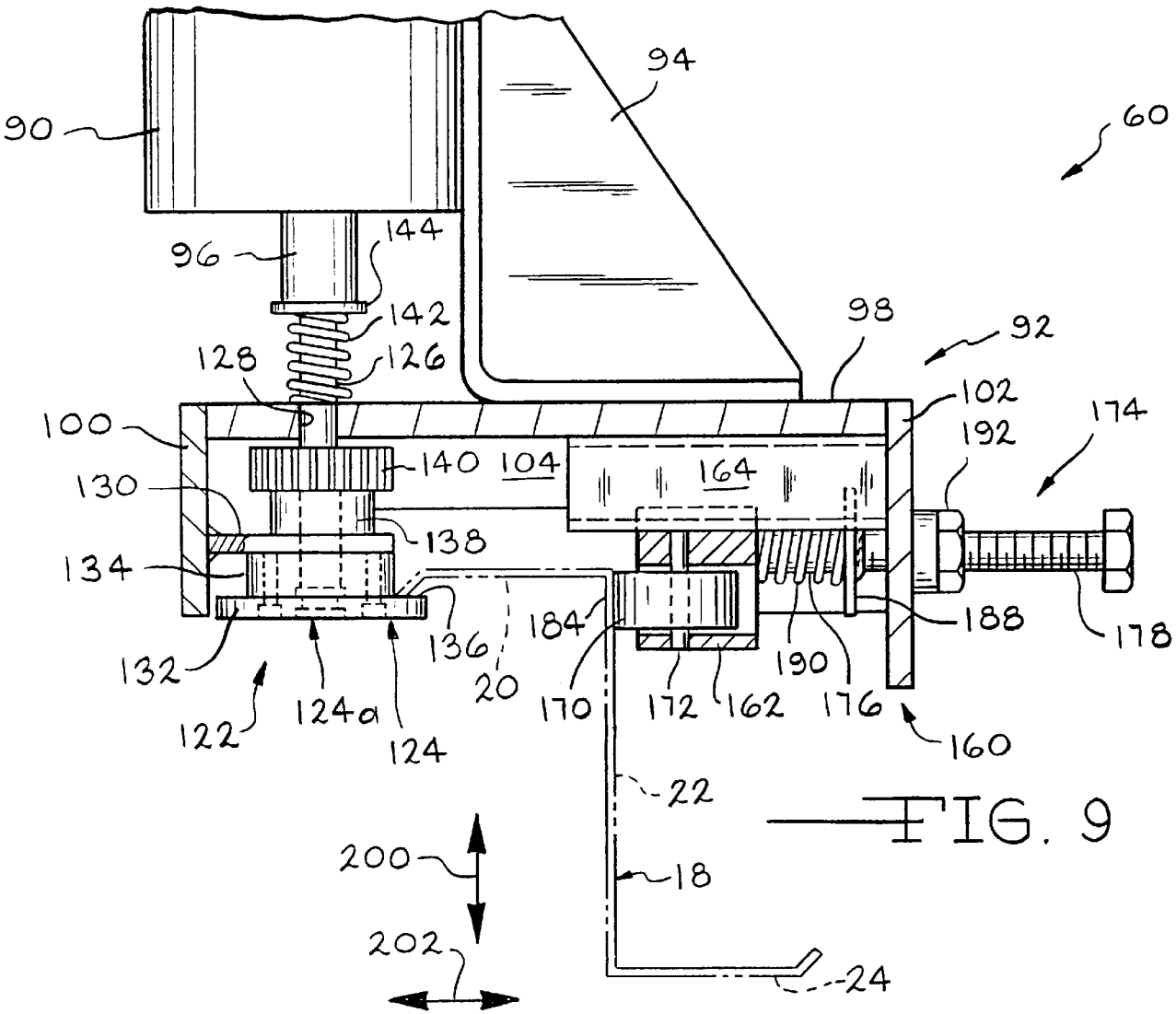
FIG. 9 is a partial sectional view of the puller assembly taken along Lines 9—9 of FIG. 8.
Figure 10:
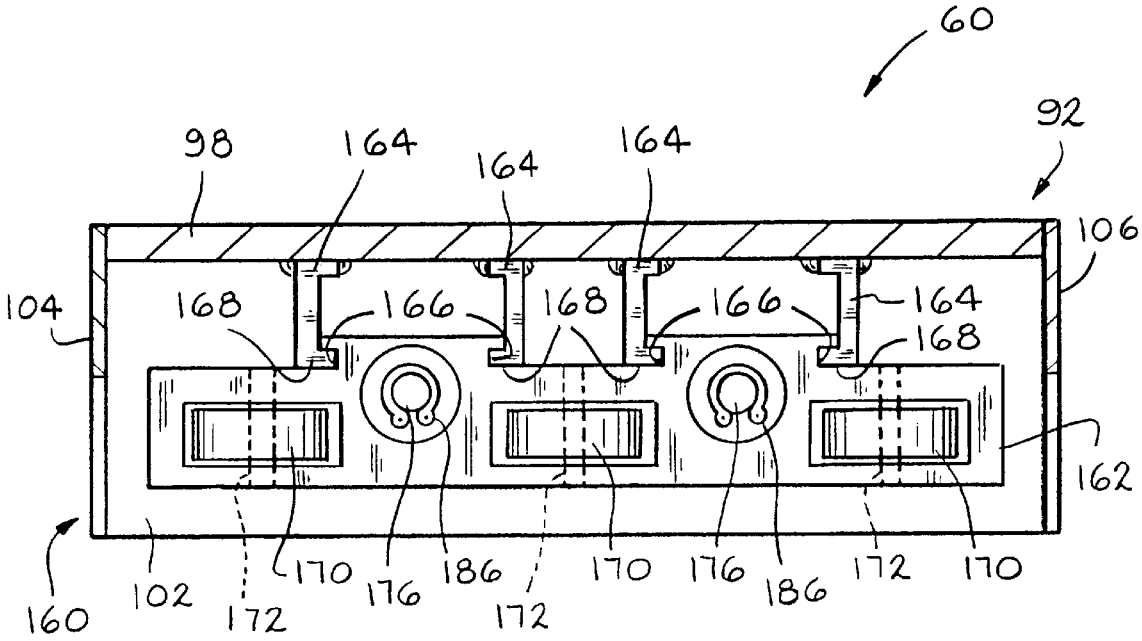
FIG. 10 is a partial sectional view of the puller assembly taken along Lines 10—10 of FIG. 8.

Referring now to FIGS. 8 through 10, the puller assembly further includes a non-driven assembly, indicated generally at 160. The non-driven assembly 160 includes a housing block 162 slidably mounted on channel members 164 attached to the upper plate 98. The housing block has grooves 166 formed therein which cooperate with flanges 168 formed in the channel members to provide the sliding mounting arrangement. The housing block is movable in a horizontal direction towards or away from the purlin. Three non-driven wheels 170 are rotatably mounted in the housing block by pins 172 fastened to the housing block. The non-driven wheels 170 are oriented in a similar manner to the wheel 82 in FIG. 5. The term "non-driven driven wheels" is defined herein as wheels which are not operatively connected to the output shaft of the motor, but are rather free to rotate about their axes. The term "driven wheels" is defined herein as wheels which are operatively connected to the output shaft of the motor. Preferably, the housing block is biased in a direction towards the purlin, such as by a pair of spring assemblies 174. The spring assemblies include a rod 176 having a threaded portion 178 threadably engaged with a threaded bore 180 formed in the side plate 102. Each rod has an end 182 which is disposed in a respective bore 184 formed through the housing block. Snap rings 186 are fastened to the ends 182 to retain the housing block from moving beyond the end 182 of the rods. The spring assemblies further include washers 188 attached to the rods. Springs 190 are disposed around the rod and positioned between the washers 188 and the housing block. The springs bias the housing block, and the non-driven wheels 170, against the vertical web 22 of the purlin 18. The position of the rods can be adjusted by threadably advancing the rods with respect to the threaded bores 180 and then tightening lock nuts 192 to secure the position of the rods. By changing the position of the rods, the spring force acting against the housing block can be adjusted. Of course, any suitable locking mechanism, such as a clamp (not shown), can be used to position the rods.

As best shown in FIG. 9, the puller assembly 60 has a driving configuration similar to the driving configuration 80, illustrated in FIG. 5. The non-driven wheels 170 are frictionally engaged with the top portion 84 of the vertical web 22 of the purlin. The driven wheels 124 are frictionally engaged with the edge 88 of the purlin 18 such that the edge 88 is adjacent the shoulder 136. Specifically, the pressing of the small diameter portion 134 against the edge 88 of the purlin drives the puller assembly and carriage along the purlins. Thus, the rollers 110 and the shoulders 136 of the driven wheels 124 cooperate to fix the vertical position of the puller assembly with respect to the purlin, as represented by an arrow 200 in FIG. 9. However, the springs 142 permit limited movement of the driven wheels 124 in the vertical direction to overcome obstacles encountered as the puller assembly moves along the length of the purlins. Also, the small diameter portions 134 of the driven wheels 124 cooperate with the non-driven wheels 170 to fix the position of the puller assembly with respect to the purlin in the horizontal direction, represented by an arrow 202 in FIG. 9. The spring assemblies 174 permit limited movement of the non-driven wheels 170 in the horizontal direction 202.

To propel the carriage in the downstream direction 28, the motor 90 is energized to rotate the output shaft 96 in a clockwise direction, as viewing FIG. 8. The output shaft imparts a clockwise rotation on the gears 140 of the driven wheels 124. Note that the idler gears 152 will rotate in a counterclockwise direction thereby imparting a clockwise rotation on the gears 140. Rotation of the driven wheels 124 will propel the puller assembly in the downstream direction along the length of the purlins, thereby pulling the carriage 26.

A logic circuit (not shown) may be incorporated into the controls of the motor 90 so that the motor is operated for a predetermined amount of time. Thus, a worker can depress a single switch which operates the motor to rotate the driven wheels 124 as described above, for a predetermined amount of time corresponding to a selected distance of movement of the carriage. The logic circuit would enable the carriage to be moved, for example, by a distance approximately equal to the width of the sheets of the hard roofing material 40.

To provide a high frictional engagement between the surfaces of the driven wheels 124, the surfaces of the non-driven wheels 170, and the surfaces of the purlin, the surfaces of the small diameter portion 134 of the driven wheels 124 and/or the non-driven wheels 170 can be made of an elastomeric material, such as rubber. Alternatively, the surfaces of the driven wheels and/or the surfaces of the non-driven wheels can be knurled or textured in some other manner.

Although the puller assembly 60 is shown and described as being attached to the carriage 26 by the cable 120, it should be understood that the puller assembly could be attached by any other suitable means, or could be mounted on the carriage. Although the wheels 170 are described alone as being non-driven, it is to be understood that they could also be driven.

Figure 11:
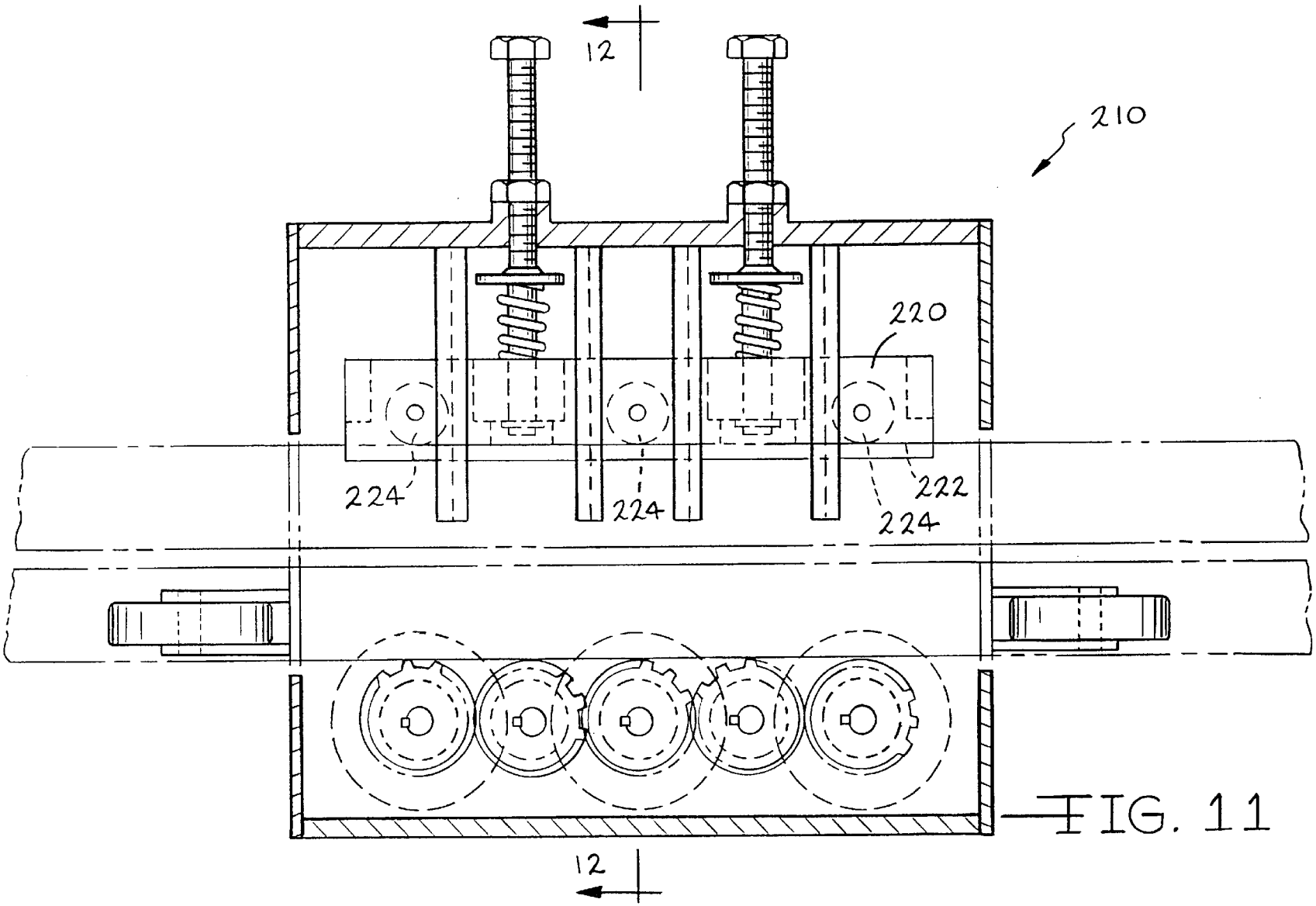
FIG. 11 is a partial sectional view of second embodiment of a puller assembly, in accordance with the present invention.
Figure 12:
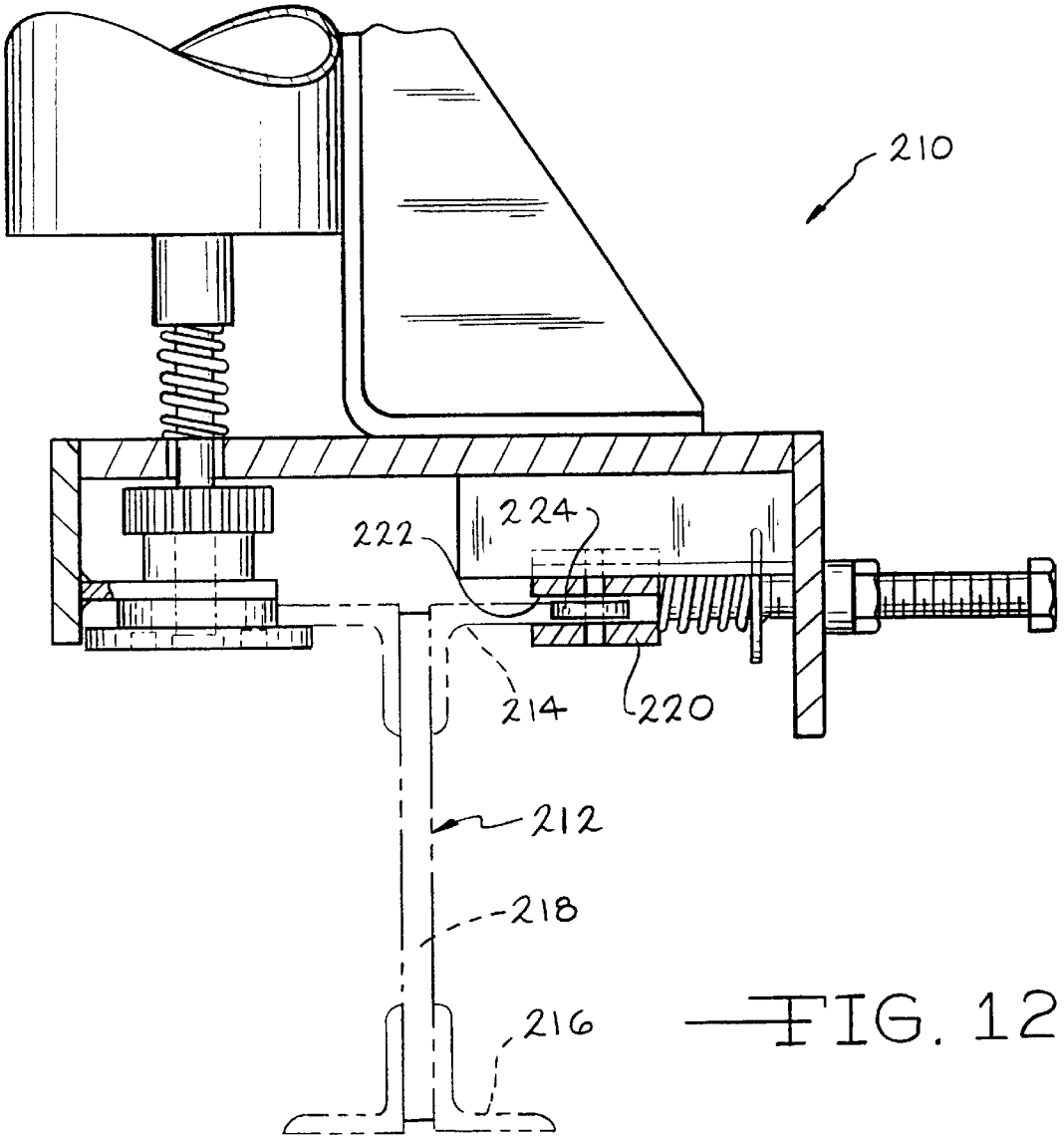
FIG. 12 is a partial sectional view of the puller assembly taken along Lines 12—12 of FIG. 11.

There is illustrated in FIGS. 11 and 12, a second embodiment of a puller assembly, indicated generally at 210. The puller assembly 210 is similar in structure and function to the puller assembly 60 of FIGS. 1 through 10, with the exception that the puller assembly 210 is configured to move along a bar joist 212 generally having an I-shaped cross-section. The bar joist has a horizontally extending upper flange 214 and a horizontally extending lower flange 216 separated by rods 218. The puller assembly 210 includes a housing block 220 having a slot 222 formed therein. Three non-driven wheels 224 are rotatably mounted in the slot of the housing. The righthand edge of the upper flange 214, as viewing FIG. 12, is disposed within the slot 222 and engages the non-driven wheels 224.

The principle and mode of operation of this invention have been described in its preferred embodiments. However, it should be noted that this invention may be practiced otherwise than as specifically illustrated and described without departing from its scope.

What is claimed is:

1. An apparatus movable along a roof structure having a plurality of purlins spaced apart from one another in a parallel arrangement, the apparatus comprising:

a carriage movable along the length of the purlins for dispensing a support sheet from a roll for support of insulation material as the carriage travels along the length of the purlins so that the support sheet depends from the top portion of adjacent purlins; and a puller assembly attached to the carriage, the puller assembly including:

a driven wheel adapted to frictionally engage the surface of a purlin;

a drive mechanism for rotating the driven wheel; and a non-driven wheel frictionally engaged with a surface of the purlin, such that the driven wheel and the non-driven wheel are positioned on opposing sides of the purlin.

2. The apparatus of claim 1 further including a second wheel frictionally engaged with another surface of the purlin, wherein the driven wheel and the second wheel are positioned on opposing sides of the purlin.

3. The apparatus of claim 2, wherein the driven wheel and the second wheel are biased in a direction towards one another by a spring.

4. The apparatus of claim 3, wherein the position of the spring is adjustable to change the spring force acting on the driven wheel and the second wheel.

5. The apparatus of claim 2, wherein the driven wheel and the second wheel are mounted for movement in a direction towards and away from each other.

6. The apparatus of claim 2, wherein the second wheel is connected to the drive mechanism for rotation thereby.

7. The apparatus of claim 1, wherein the driven wheel has a surface made of an elastomeric material to frictionally engage the surface of the purlin.

8. The apparatus of claim 1, wherein the driven wheel has a knurled surface to frictionally engage the surface of the purlin.

9. The apparatus of claim 1, wherein the driven wheel includes a first diameter portion and second diameter portion which is larger than the first diameter portion, the first and second diameter portions being adjacent to each other forming a shoulder.

10. The apparatus of claim 1, wherein the driven wheel is mounted for rotation on an axis, and wherein the driven wheel is mounted for movement in a direction parallel to the axis.

11. The apparatus of claim 1, wherein the drive mechanism includes a motor.

12. The apparatus of claim 11, wherein the drive mechanism includes a logic circuit which is actuated by a single switch such that upon actuation of the switch, the logic circuit operates the motor for a predetermined amount of time.

13. The apparatus of claim 1, wherein the puller assembly has a roller which rolls along an upper portion of the purlin as the carriage moves along the length of the purlins.

14. The apparatus of claim 1, wherein the puller assembly is attached to the carriage by a cable.

15. An apparatus movable along a roof structure having a plurality of purlins spaced apart from one another in a parallel arrangement, the apparatus comprising:

a carriage movable along the length of the purlins for dispensing a support sheet from a roll for support of insulation material as the carriage travels along the length of the purlins so that the support sheet depends from the top portion of adjacent purlins; and a puller assembly attached to the carriage, the puller assembly including:

a plurality of driven wheels frictionally engaged with a surface of a purlin;

a drive mechanism for rotating the driven wheel; and a plurality of non-driven wheels frictionally engaged with a surface of the purlin, such that the driven wheels and the non-driven wheels are positioned on opposing sides of the purlin.

16. The apparatus of claim 15, wherein the plurality of driven wheels and the plurality of non-driven wheels are biased in a direction towards one another by a spring.

17. A method of propelling a carriage along a plurality of purlins, the method comprising the steps of:

a. providing a carriage upon which is mounted a roll of support sheet, wherein the support sheet has side edges which are generally aligned with the top portions of adjacent purlins so that the support sheet can depend from the adjacent purlins;

b. providing a puller assembly for rotating a driven wheel, the puller assembly being attached to the carriage;

c. positioning the driven wheel adjacent a purlin for frictional engagement therewith;

d. actuating the puller assembly to rotate the driven wheel so that the driven wheel rolls along the length of the purlin, thereby propelling the carriage along the purlins.

18. The method of claim 17 including the step of positioning a non-driven wheel on the opposing side of the purlin for frictional engagement therewith.

19. The method of claim 18, wherein the driven wheel and the non-driven wheel are biased in a direction towards one another by a spring.

20. The method of claim 19, wherein the spring force acting on the driven wheel and the non-driven wheel is adjutable.

* * * * *